United States Patent [19]

Nasatka

[11] Patent Number: 4,574,523

[45] Date of Patent: Mar. 11, 1986

[54] VEHICLE BARRICADE OR MAXIMUM SECURITY BARRIER

[76] Inventor: Ralph G. Nasatka, 8405 Dangerfield Pl., Clinton, Md. 20735

[21] Appl. No.: 593,884

[22] Filed: Mar. 27, 1984

[51] Int. Cl.[4] ..... E01F 13/00

[52] U.S. Cl. ..... 49/49; 49/387

[58] Field of Search ..... 49/49, 131, 35, 387; 404/6, 9

[56] References Cited

U.S. PATENT DOCUMENTS

| | | | |
|---|---|---|---|
| 1,949,295 | 2/1934 | Dean | 49/49 X |
| 3,478,464 | 11/1969 | Appel | 49/35 X |
| 3,626,638 | 12/1971 | Lafferty | 49/49 |
| 4,152,871 | 5/1979 | Kardash, Jr. | 49/49 |
| 4,354,771 | 10/1982 | Dickinson | 49/49 X |
| 4,490,068 | 12/1984 | Dickinson | 49/49 X |

*Primary Examiner*—Philip C. Kannan

*Attorney, Agent, or Firm*—Shlesinger, Arkwright, Garvey & Fado

[57] ABSTRACT

A vehicle barricade has two concrete walls contiguously disposed along either side of a roadway for defining a checkpoint. A shaft is pivotally secured to the roadway and extends transversely between the concrete walls. A barrier plate is pivotal with the shaft between a first horizontal position and a second angularly disposed position adapted for preventing vehicle passage through the checkpoint by engagement of the barrier plate with the vehicle. A shaft retaining system is provided for preventing removal of the shaft and the barrier plate therewith from the roadway surface.

17 Claims, 7 Drawing Figures

FIG 1
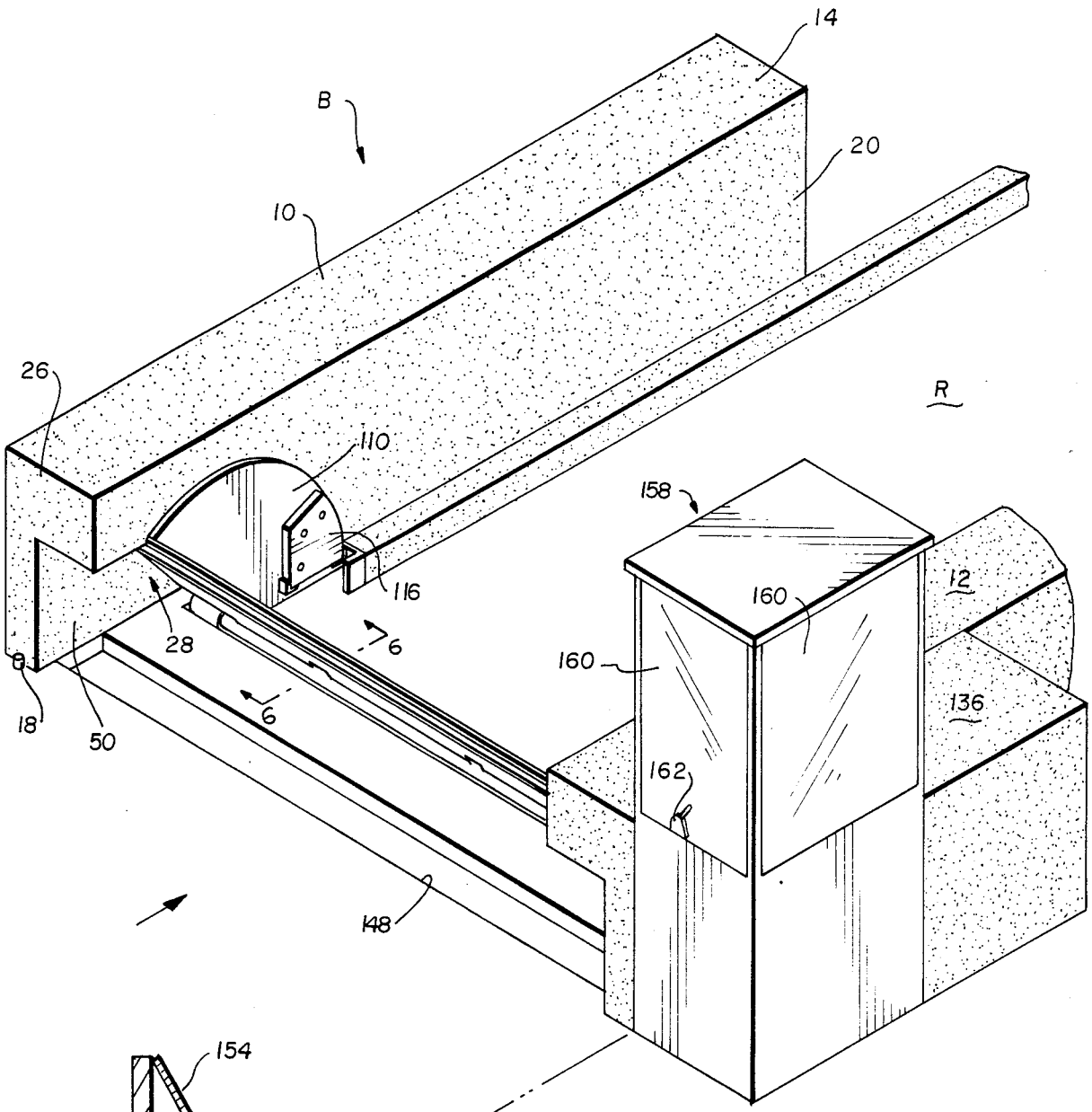
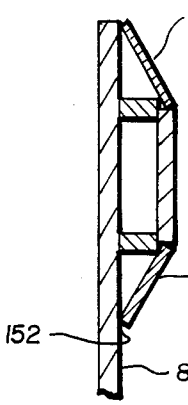
FIG 7
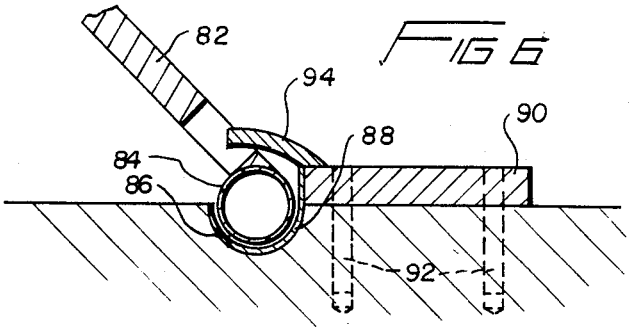
FIG 6

VEHICLE BARRICADE OR MAXIMUM SECURITY BARRIER

BACKGROUND OF THE INVENTION

Recent experience has indicated the desirability of preventing unrestricted vehicle access to parking areas, particularly underground garages and the like. Terrorists have been known to drive explosives loaded trucks and cars into building parking areas for the purpose of destroying the building and killing the individuals located thereabout. Frequently, these terrorists drive the explosive loaded vehicle and detonate same while still seated therein. Consequently, a means for preventing the unrestricted ingress of vehicles into surface and subterranean parking areas is desirable in order to avoid these terrorists explosions.

Kardash, U.S. Pat. No. 4,152,871 discloses a vehicle barricade having a movable barrier plate pivotally disposed on a shaft transversely extending between two spaced concrete pillars. Means are provided for pivoting the barrier plate between a horizontal position and an angularly disposed blocking position. The vehicle barricade of Kardash does not completely solve the problems of a selectively operable vehicle barricade and improvement thereof is necessary.

The disclosed invention provides a novel and unique vehicle barricade which is selectively operable between a horizontal position and an angularly disposed blocking position. The barrier plate is secured to a pivotable shaft which is mounted in a semi-circular cylindrical recess extending along the roadway surface between a pair of concrete walls. The shaft receiving system is securely fastened to the roadway and includes means for preventing removal of the shaft from the shaft receiving system. An observation booth is provided adjacent one of the walls and includes means for operating the cylinder and piston assembly which pivots the barrier gate. The barrier gate has a reinforcing member secured to one surface thereof in order to strengthen the barrier gate. The concrete walls have a reinforced framework to prevent damage to the walls as well as to absorb the impact forces caused by collision of a vehicle with the barrier plate. Consequently, one skilled in the art will appreciate that the disclosed vehicle barricade is a significant advance in the art.

OBJECTS AND SUMMARY OF THE INVENTION

The primary object of the disclosed invention is to provide a vehicle barricade having a barricade plate pivotally secured to the roadway.

Another object of the disclosed invention is to provide a sleeve and finger system engagable with the barricade plate for preventing removal thereof from between the concrete walls of the barricade.

Another object of the disclosed invention is to provide a reinforced framework for the barricade concrete walls in order to prevent damage thereto and to absorb the impact forces caused by collision of a vehicle.

Still another object of the disclosed invention is to provide an observation booth adjacent the barricade having means for operating the barrier plate pivoting mechanism.

Still another object of the disclosed invention is to provide a reinforcing member securely fastened to at least one surface of the barricade plate.

Yet a further object of the disclosed invention is to provide that at least a portion of the concrete walls extend longitudinally beyond the barricade plate to prevent the placement of an article which would prevent pivoting of the plate.

Still yet another object of the disclosed invention is to provide an observation booth having a control system connected to the means for pivoting the barrier plate.

These and other objects and advantages of the invention will be readily apparent in view of the following description and drawings of the above-described invention.

DESCRIPTION OF THE DRAWINGS

The above and other objects and advantages and novel features of the present invention will become apparent from the following detailed description of the preferred embodiment of the invention illustrated in the accompanying drawings, wherein:

FIG. 1 is a fragmentary perspective view of the barricade of the invention;

FIG. 6 is a fragmentary cross-section view showing the hinge area of the barricade in detail; and, FIG. 7 is a fragmentary cross-sectional view of another embodiment of the barrier plate of the invention.

DESCRIPTION OF THE INVENTION

A vehicle barricade or checkpoint B, as best shown in FIG. 1, is disposed for interdicting a roadway R. While a roadway R is disclosed, the barricade B is intended for blocking or interdicting the approach ramp to an underground garage, a vehicle entrance to a building, a vehicle entrance to a parking lot and the like. Consequently, the barricade B is capable of being adapted for performing the required functions at any location where the necessity of stopping and preventing the further movement of a vehicle, particularly a vehicle loaded with explosives, is desired. The disclosed barricade B may be readily adapted for stopping trucks and other vehicles of a weight in excess of eight tons and moving at a speed of up to 50 MPH.

A first concrete wall 10 is contiguously disposed generally along one side of roadway R. Another similar second concrete wall 12 is disposed along the other side of roadway R and extends longitudinally approximately the same length as does first concrete wall 10. The concrete shall preferably have a compressive strength at 28 days of at least 3,000 psi. Only potable water should be used in the mixing of the concrete and all concrete exposed to air should receive a 4% air-entraining admixture. Due to the necessity for absorbing the high impact forces caused by collision of a rapidly moving heavy vehicle, it is necessary that the concrete be of the highest quality in order to assure that the barricade B can withstand that impact force.

The concrete walls 10 and 12 are each essentially mirror images of the other. Consequently, only the concrete wall 10 will be thoroughly described but one skilled in the art will appreciate that the concrete wall 12 will be similarly constructed.

Figure 3:
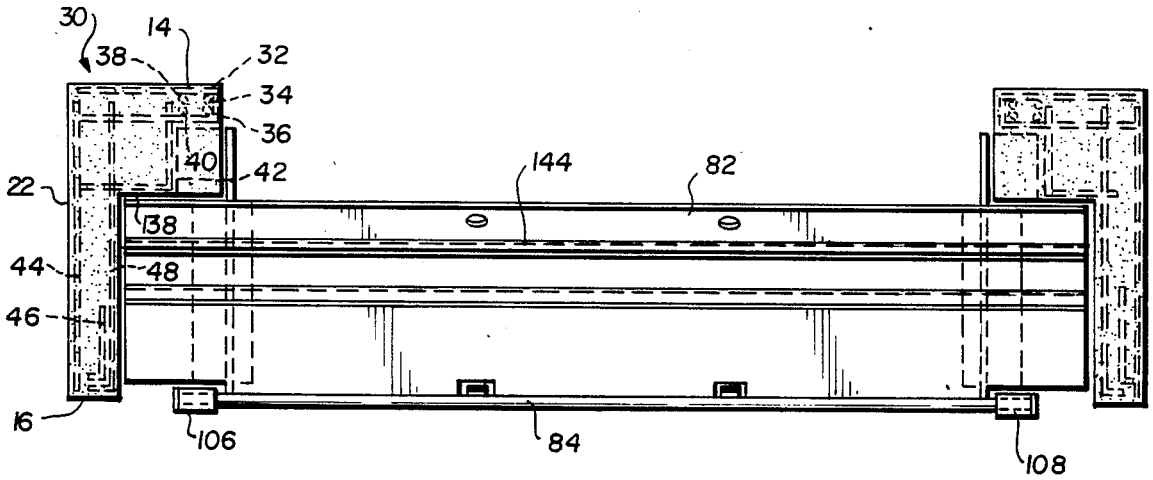
FIG. 3 is a front elevational view of the barricade of FIG. 1 with portions shown in phantom.

Wall 10 has a top surface 14 and a bottom surface 16, as best shown in FIG. 3, adapted for being disposed on roadway. Preferably a plurality of expansion bolts 18 are provided in bottom surface 16, although only one expansion bolt 18 is shown in FIG. 1. The bolts 18 are longitudinally aligned for securely fastening wall 10 to the roadway R. Although expansion bolts 18, of a type well known in the art, are disclosed for fastening the wall 10 to roadway R, one skilled in the art will appreciate that many other fastening means may be utilized. The utilization of expansion bolts 18, however, is preferred as this permits adaptation of the barricade B for utilization in areas where excavation for foundations is prohibited.

The wall 10 has an inner side surface 20 as well as an outer side surface 22. Inner and outer side surfaces 20 and 22, respectively, are disposed in spaced parallel relationship with each other and have substantial height. Rear surface 24 extends transversely between inner and outer side surfaces 20 and 22, respectively, and spans top and bottom surfaces 14 and 16. An inverted L-shaped front surface 26 is provided and defines a rearwardly extending recess 28, the function of which will be explained herein later.

Figure 2:
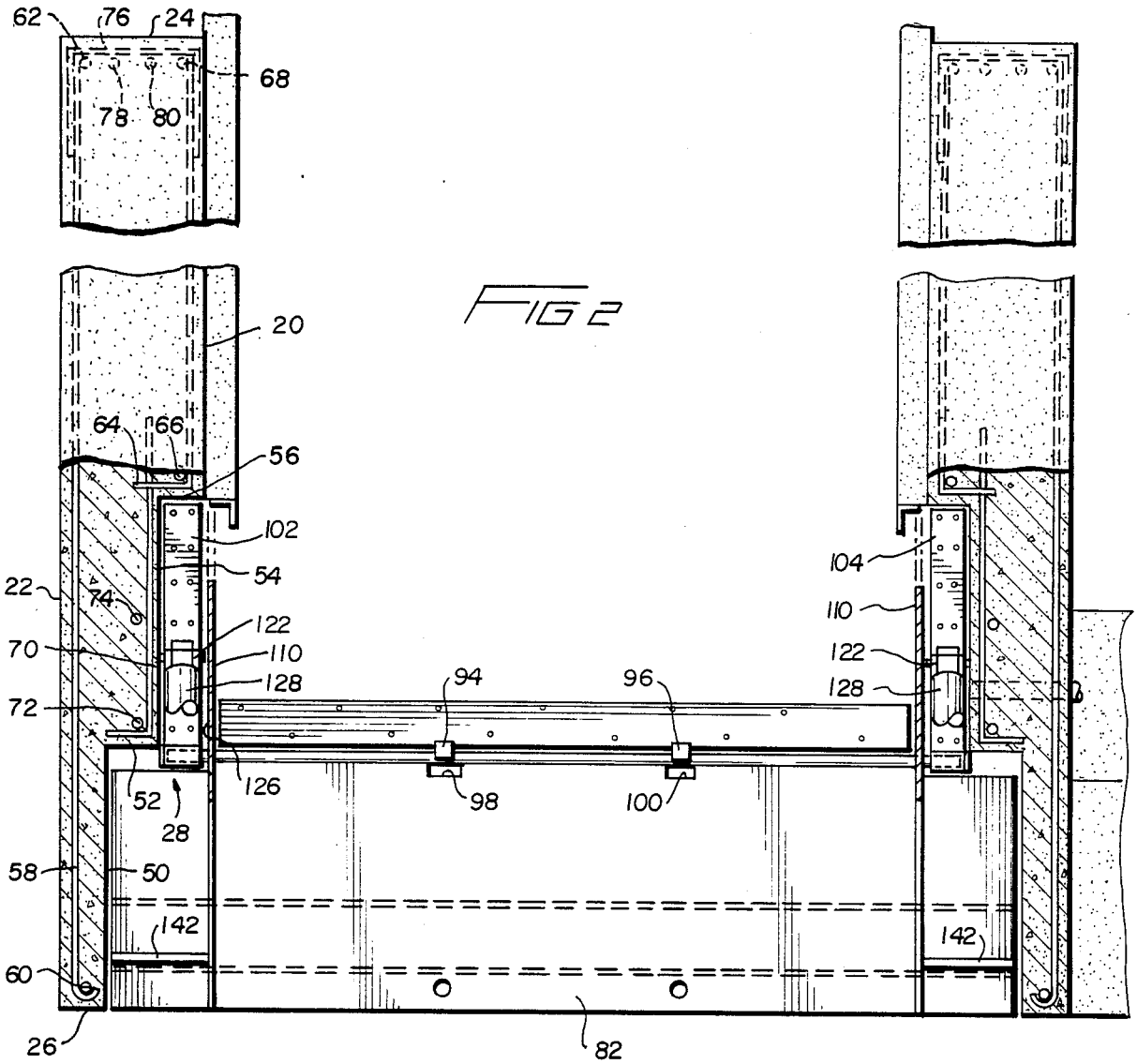
FIG. 2 is a fragmentary top plan view of the barricade of FIG. 1 with portions broken away and with portions shown in phantom.

In order to withstand the impact forces associated with collision by a rapidly moving heavy vehicle, it is necessary that the wall 10, as well as the wall 12, be reinforced. A reinforced framework 30 is disposed in each of the concrete walls 10 and 12 and is best shown in FIGS. 2 and 3. Because of the similarlity of design of the framework 30 for each of the walls 10 and 12, the framework 30 for the wall 10 will alone be described but one skilled in the art will appreciate that a similar framework 30 will be provided for concrete wall 12.

U-shaped reinforcing rod 32 is provided and is spaced a slight distance inwardly from front surface 26 and slightly below top surface 14. Preferably the reinforcing rod 32, as well as the other reinforcing members herein to be described, shall be of steel composite and shall conform to ASTM A36. Spaced parallel reinforcing members 34, 36, 38 and 40 extend longitudinally rearwardly along inner surface 20. The rods 34 and 36 are spaced slightly inwardly of surface 20 while the rods 38 and 40 are spaced a greater distance inwardly from inner side surface 20. Preferably the rods 34–40 extend generally from front surface 26 to rear surface 24. A right angle reinforcing rod 42 is provided adjacent front surface 26 and one leg of the rod 42 extends from generally outer side surface 22 to generally adjacent rod 40 and 38 while the other leg extends upwardly therefrom. Vertically extending reinforcing rods 44, 46, and 48 are provided inwardly a slight distance from front surface 26 adjacent bottom 16. Rod 44 preferably extends generally between top surface 14 and bottom surface 16 while rod 48 does likewise. Rod 46 is generally L-shaped and the foot of the L is connected to one of expansion bolts 18. It can be appreciated that a plurality of vertical rods 44, 46, and 48 are provided along the length of wall 10 and that the rods 44, 46, and 48 are all longitudinally aligned. Each expansion bolt 18 is connected to one leg of a vertical rod 46.

Recess 28 is defined by a longitudinally rearwardly extending wall portion or surface 50, which is parallel to outer side surface 22, and wall surface or portion 52 generally transverse thereof and angularly disposed to roadway R. A second wall portion or surface 54 extends longitudinally parallel to outer side surface 22 from transverse portion 52 while a transverse portion 56 extends from the rearward end of portion 54. Consequently, recess 28 has a double L-shaped configuration. The wall elements 50–56 have a height less than the distance between top surface 14 and bottom surface 16 with the effect that the foot of the L of front portion 26 has a substantial thickness for receiving the previously described framework.

Longitudinally rearwardly extending reinforcing member 58 is spaced inwardly a slight distance from side surface 22 and is keyed to front vertical reinforcing member 60 and rear vertical reinforcing member 62. L-shaped reinforcing member 64 extends generally rearwardly from transverse element 56 with the foot of the L of reinforcing member 64 spaced a slight distance from element 56. The reinforcing member 64 is keyed to vertical member 66 which is adjacent transverse element 56 and rear vertical member 68. A second L-shaped reinforcing member 70 has the foot of the L adjacent and spaced from transverse element 52 with the leg of the L extending generally rearwardly past the foot of the L of reinforcing member 64. Member 70 is keyed to vertical members 72 and 74. U-shaped reinforcing member 76 is provided adjacent rear surface 24 and the base of the U is connected to vertical elements 62 and 68 as well as to elements 78 and 80 which are disposed parallel thereto. It can be appreciated that a plurality of reinforcing members 58, 70, 64, and 76 will be provided and maintained in a stacked spaced relationship in order to add strength to concrete wall 10 throughout its length and height. Consequently, the framework 30, which is provided by the various previously described reinforcing members, provides a high strength concrete wall adapted for absorbing and resisting the impact forces caused by collision with a rapidly moving vehicle and which will not separate from the roadway R to which the concrete wall 10 is secured.

A barrier plate 82 is secured by welding or the like to pivotable shaft 84. As best shown in FIG. 6, a generally semi-circular cylindrical recess 86 is disposed in roadway R generally along the surface thereof and spans substantially the distance between concrete walls 10 and 12 in the area of recesses 28. A J-shaped steel receiving member 88 is disposed in recess 86. Mounting plate 90 which is secured by expansion bolts 92 to roadway R is secured by welding or the like to member 88 and is disposed rearwardly therefrom. Shaft 84 is disposed within the arcuate area of J-shaped member 88 and is adapted for pivoting therein on a pivot axis.

Two angularly upwardly extending fingers 94 and 96 extend forwardly from mounting plate 90 and are aligned with apertures 98 and 100, respectivley, in barrier plate 82. The fingers 94 extend only a slight.distance upwardly beyond mounting plate 90 so as not to damage the tires of a vehicle. The fingers 94 and 96 extend through apertures 98 and 100, respectively, when the barrier plate 82 is pivoted to the angularly disposed position, best shown in FIG. 1, and thereby prevent removal of the shaft 84, as well as the barrier plate 82 from between the concrete walls 10 and 12.

Longitudinally extending spaced parallel mounting plates 102 and 104 are disposed within the L defined by elements 54 and 56 and are secured to roadway R by expansion bolts or the like. The forward end portion of mounting plates 102 and 104 includes shaft receiving portions 106 and 108, respectively. Each of shaft receiving portions 106 and 108 includes a cylindrical recess coaxially aligned with shaft 84 and adapted for permitting pivoting of shaft 84. The shaft receiving portions 106 and 108 prevent removal of the shaft 84 from shaft receiving member 88, particularly when the barrier plate 82 is in the horizontal position, as best shown in FIG. 2. Consequently, the barricade B includes a shaft removal prevention system which prevents removal of the shaft 84, as well as the barricade 82, from between the concrete walls 10 and 12, regardless of the angular position of the barrier plate 82 relative to roadway R. Similarly, the finger 94 and 96, in cooperation with member 88, prevent movement of the shaft 84 when the barrier plate 82 is struck by a vehicle, a problem with prior art barricades. This shaft removal prevention system prevents a terrorist from sneaking up on the barricade B and surreptitiously removing the shaft 84 from its shaft receiving and pivot axis defining member 88.

Figure 4:
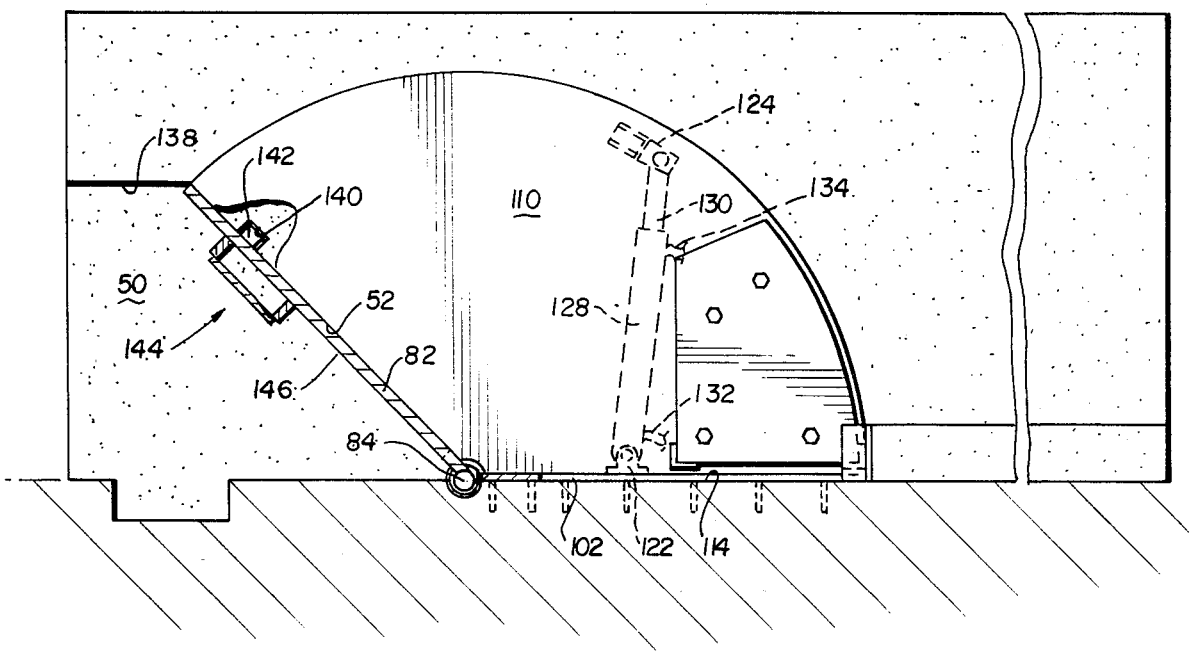
FIG. 4 is a fragmentary side elevational view with portions broken away and with the barrier plate shown in the angularly disposed position.

Arcuate contoured steel plates 110 extend upwardly from upper surface 112 of barrier plate 82. Each of plates 110 is disposed inwardly from its associated edge of barrier plate 82 and is generally aligned and spaced from inner side surface 20. As best shown in FIG. 4, plate 110 has a roadway contacting edge 114 adapted for engaging the surface of roadway R when the barrier plate 82 is in the angularly disposed orientation, as best shown in FIG. 4. Similarly, edge 114 is angularly disposed relative to roadway R when the barrier plate 82 is in the horizontal disposition shown in FIG. 5. Counterweights 116 are secured by bolts 118 or the like to plates 110. Preferably L-shaped brackets 120 are disposed generally adjacent edge 114 for securely maintaining the bottom edge of the counterweights 116. The counterweights 116 independently maintain the barrier plate 82 in the horizontal disposition without the need for any other force. Similarly, the counterweights 116 facilitate the pivoting of the barrier plate 82 from the horizontal disposition to the angularly disposed disposition.

A mounting bracket 122 is secured to each of mounting plates 102 and 104. Another bracket 124 is mounted on the inside surface 126 of each of plates 110. A cylinder and piston assembly 128 is pivotally connected to each set of mounting bracket 122 and bracket 124. The cylinder and piston assemblies 128 are adapted for pivoting the barrier plate 82 between the horizontal configuration and the angularly disposed configuration as shown in FIG. 4. It can be noted in FIG. 5, that the piston 130 of cylinder and piston assembly 128 is, preferably, in the extended position when the barrier plate is in the horizontal position. Similarly, retraction of piston 130 by utilization of hydraulic lines 132 and 134 will cause the barrier plate to pivot to the angularly disposed position wherein an angle of 45° to the horizontal is established. The motors and pumps for operating the cylinder and piston assembly 128 are contained in a concrete housing 136 disposed adjacent concrete wall 12 and are of a type well known in the art.

Figure 5:
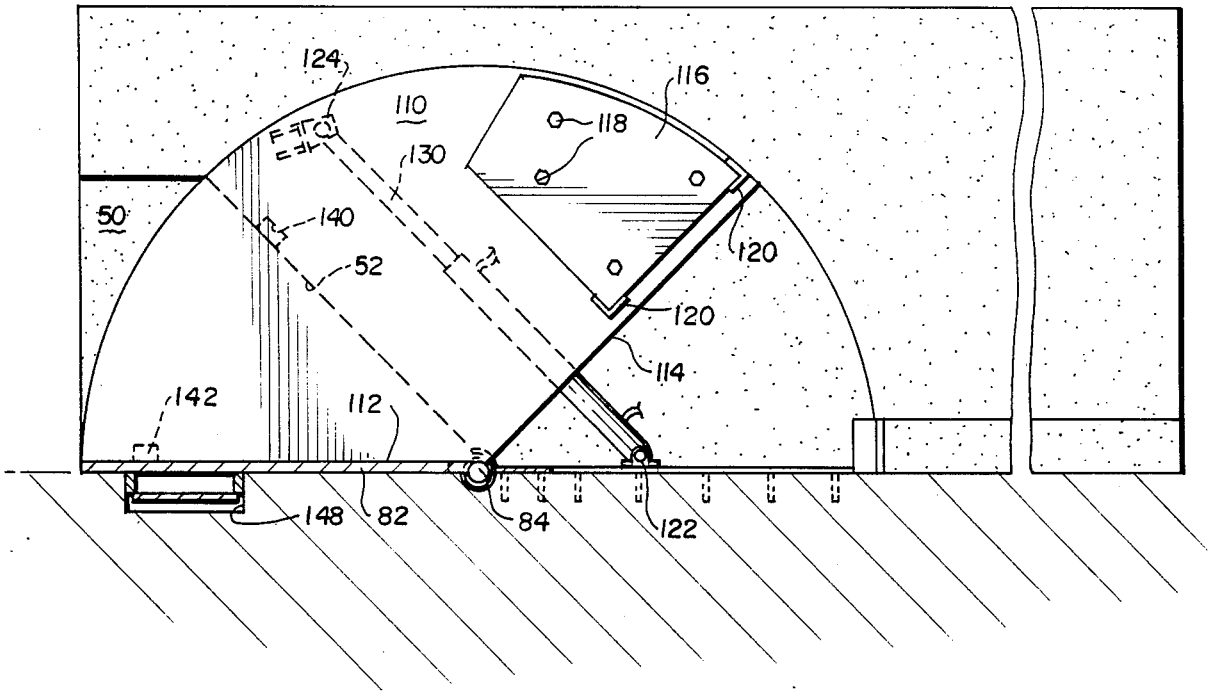
FIG. 5 is a fragmentary side elevational view as in FIG. 4 with the barrier plate shown in the horizontal position.

As best shown in FIGS. 4 and 5, wall element 52 extends angularly from top surface 138 of recess 28. Preferably wall element 52 has a rectangular recess 140 along the edge thereof for engaging and aligning with key 142 secured to the outer edges of barrier plate 82. The key 142 makes certain that the barrier plate 82 is in the proper angular orientation when the piston 130 is retracted.

The barricade B must be capable of withstanding the impact forces caused by the collision of a rapidly moving heavy vehicle with the barrier plate 82. While the angularly disposed wall portions 52 have substantial width, as best shown in FIG. 2, for engaging and supporting the ends of the barrier plate 82, it is preferred that the barrier plate 82 be reinforced to add additional strength. Toward that end, a steel box beam 144, as best shown in FIGS. 4 and 5, is secured by welding or the like to first surface 146 of barrier plate 82. Steel box beam 144, which also includes a channel, extends along the length of barrier plate 82, as best shown in FIG. 3, and is secured generally above the midpoint of barrier plate 82. A rectangular recess 148 is provided in roadway R and is adapted for receiving therein box beam 144 when the barrier plate 82 is in the first horizontal configuration. In this way, a vehicle may travel over barrier plate 82 through checkpoint B. The box beam 144, when the barrier plate 82 is in the second angularly disposed orientation, helps to direct the colliding vehicle downwardly in order to prevent the vehicle from being deflected upwardly and over barrier plate 82. Consequently, the box beam 144 not only serves to reinforce and thereby assist the barrier plate 82 in absorbing the impact forces caused by collision with a heavy vehicle, but also serves the purpose of downwardly directing that colliding vehicle.

Another embodiment of barrier plate 82 is shown in FIG. 7. Box beam 150 is secured by welding or the like to second surface 152 of barrier plate 82. Ramps 154 and 156 are provided on either side of box beam 150. The ramps 154 and 156 in cooperation with the box beam 150 provide a speed bump when the barrier plate 82 is in the first horizontal disposition. In this way, the reinforcing box beam 150 also serves the advantageous function of providing a means for assuring that a vehicle is moving at a low rate of speed as it passes through the barricade B.

Preferably an observation booth 158 is provided adjacent concrete wall 12 and concrete housing 136. Observation booth 158 has windows 160 on all the sides thereof to permit viewing of roadway R in order to observe the oncoming traffic. Hydraulic controller 162 is provided in observation booth 158 and controls the operation of the motors and hydraulic pumps contained in concrete housing 136. Consequently, the operation of barrier plate 82 may be selectively controlled by an attendant housed in observation booth 158. The concrete walls 10 and 12, therefore, provide a checkpoint disposed for interdicting roadway R. The attendant in observation booth 158 may observe the oncoming vehicles and selectively raise and lower barrier plate 82 by operation of controller 162. Consequently, the barricade B is uniquely adapted for independently permitting vehicular traffic by individual vehicles. While an observation booth 158 is shown closely adjacent barricade B, one skilled in the art will appreciate that other means of observing the vehicular traffic, such as remote television monitoring, would also permit similar operation of barricade or checkpoint B.

While this invention is described as having a preferred design, it is understood that it is capable of further modifications, uses and/or adaptations of the invention following in general the principles of the invention and including such departures from the present disclosure as come within known or customary practice in the art to which the invention pertains, and as may be applied to the central features hereinbefore set forth, and fall within the scope of the invention of the limits of the appended claims.

What I claim is:

1. A vehicle barricade for roadways or the like, comprising:

(a) first and second spaced generally parallel wall means contiguously disposed along opposite sides of said roadway for providing a checkpoint therebetween;

(b) shaft receiving means secured in said roadway generally along the surface thereof and extending generally transversely between said wall means;

(c) shaft means cooperatively associated with said shaft receiving means and adapted for pivoting on an axis;

(d) barrier plate means secured to said shaft means and pivotal therewith between a first generally horizontal position and a second angularly disposed position, said first position adapted for permitting vehicle passage through said checkpoint and said second position adapted for preventing vehicle passage through said checkpoint by engagement of said barrier plate means with a vehicle;

(e) said shaft receiving means includes means cooperating with said shaft means for preventing removal of said shaft means therefrom;

(f) each of said wall means includes an angularly disposed portion adapted for engaging and supporting a portion of said barrier plate means when in said second position;

(g) means associated with said barrier plate means for pivoting said barrier plate means between said first and second position;

(h) said means cooperating with said shaft means for preventing removal includes a plurality of fingers extending angularly from said shaft receiving means; and, (i) said barrier plate means has a plurality of apertures therethrough, each of said apertures is aligned with one of said fingers whereby said fingers extend through said apertures when said barrier plate means is in said second position for thereby preventing removal of said shaft means.

2. The barricade as defined in claim 1, wherein:

(a) said shaft means has spaced ends, each of said ends is spaced from and adjacent one of said wall means; and, (b) end retaining means are adjacent each of said wall means and secured to said roadway, each of said end retaining means includes a generally cylindrical recess adapted for receiving an associated one of said ends for preventing removal of said shaft means from said shaft receiving means.

3. The barricade as defined in claim 1, wherein:

(a) at least one of said wall means is secured to said roadway.

4. The barricade as defined in claim 1, wherein:

(a) said wall means includes a high strength concrete wall.

5. The barricade as defined in claim 1, wherein:

(a) each of said wall means has an outer side surface, an inner side surface, a front surface and a rear surface; and, (b) reinforcing means are disposed in each of said wall means along generally said inner side surface, said outer side surface, said front and said rear surfaces for strengthening said wall means.

6. The barricade as defined in claim 5, wherein:

(a) said reinforcing means includes a portion thereof disposed generally at said angularly disposed portion for strengthening said angularly disposed portion.

7. The barricade as defined in claim 5, wherein:

(a) said reinforcing means includes a portion thereof disposed generally horizontally and longitudinally along said inner and said outer side surfaces;

(b) at least another portion of said reinforcing means is vertically disposed in said wall means; and, (c) said horizontal reinforcing means are disposed in a series of spaced layers connected to said vertical portion for thereby providing a reinforced framework.

8. The barricade as defined in claim 5, wherein;

(a) said reinforcing means include steel reinforcing rods.

9. The barricade as defined in claim 1, wherein:

(a) each of said wall means includes an inner side surface and an outer side surface; and, (b) said outer side surface extends longitudinally forwardly beyond said angularly disposed portion for thereby preventing intentional blockage of said barrier gate means.

10. The barricade as defined in claim 9, wherein:

(a) observation means are provided at one of said wall means; and, (b) control means for operating said pivoting means are cooperatively associated with said observation means whereby said operation of said control means permits selective pivoting of said barrier plate means.

11. The barricade as defined in claim 1, wherein:

(a) bracket means are secured to said roadway;

(b) said means for pivoting said barrier plate means includes cylinder and piston means; and, (c) said cylinder and piston means are pivotally connected to said barrier plate means and said bracket means and are adapted for pivoting said barrier plate means.

12. The barricade as defined in claim 11, wherein:

(a) said barrier plate means has arcuate end plate means extending therefrom adjacent to and parallel with each of said wall means;

(b) said end plate means are counterweighted; and, (c) said cylinder and piston means are connected to said end plate means.

13. A vehicle barricade for roadways or the like, comprising:

(a) first and second generally parallel wall means contiguously disposed along opposite sides of said roadway for providing a checkpoint therebetween;

(b) shaft receiving means secured in said roadway generally along the surface thereof and extending generally transversely between said wall means;

(c) shaft means cooperatively associated with said shaft receiving means and adapted for pivoting on an axis;

(d) barrier plate means secured to said shaft means and pivotal therewith between a first generally horizontal position and a second angularly disposed position, said first position adapted for permitting vehicle passage through said checkpoint and said second position adapted for preventing vehicle passage through said checkpoint by engagement of said barrier plate means with a vehicle;

(e) said shaft receiving means includes means cooperating with said shaft means for preventing removal of said shaft means therefrom;

(f) each of said wall means includes an angularly disposed portion adapted for engaging and supporting a portion of said barrier plate means when in said second portion;

(g) means associated with said barrier plate means for pivoting said barrier plate means between said first and second positions;

(h) said barrier plate means has first and second spaced generally parallel surfaces;

(i) reinforcing means are secured to at least one of said surfaces for strengthening said barrier plate means;

(j) said first surface has said reinforcing means secured thereto; and, (k) said reinforcing means has ramped edges for thereby permitting vehicle passage over said first surface and said reinforcing means when in said first position.

14. The barricade as defined in claim 13, wherein:

(a) said reinforcing means includes a speed bump.

15. The barricade as defined in claim 13, wherein:

(a) said roadway includes a recess along the surface thereof extending transversely between said wall means; and, (b) said reinforcing means is secured to said second surface and is adapted for being received in said recess when said barrier plate is in said first position.

16. The barricade as defined in claim 15, wherein:

(a) said reinforcing means is a box beam.

17. A vehicle barricade for roadways or the like, comprising:

(a) first and second spaced generally parallel wall means contiguously disposed along opposite sides of said roadway for providing a checkpoint therebetween;

(b) shaft receiving means secured in said roadway generally along the surface thereof and extending generally transversely between said wall means;

(c) shaft means cooperatively associated with said shaft receiving means and adapted for pivoting on an axis;

(d) barrier plate means secured to said shaft means and pivotal therewith between a first generally horizontal position and a second angularly disposed position, said first position adapted for permitting vehicle passage through said checkpoint and said second position adapted for preventing vehicle passage through said checkpoint by engagement of said barrier plate means with a vehicle;

(e) said shaft receiving means includes means cooperating with said shaft means for preventing removal of said shaft means therefrom;

(f) each of said wall means includes an angularly disposed portion adapted for engaging and supporting a portion of said barrier plate means when in said second position;

(g) means associated with said barrier plate means for pivoting said barrier plate means between said first and second positions;

(h) said shaft receiving means includes an open semicircular cylindrical member adapted for receiving said shaft means;

(i) a mounting plate is secured to said cylindrical member and to said roadway;

(j) a plurality of fingers extend angularly from said mounting plate; and, (k) said barrier plate has a plurality of apertures therethrough, each of said apertures is aligned with one of said fingers and said fingers extend through said apertures when said barrier plate is in said secured position for preventing removal of said shaft means from said shaft receiving means.

* * * * *